US006927670B1

(12) United States Patent
Gokcebay et al.

(10) Patent No.: US 6,927,670 B1
(45) Date of Patent: Aug. 9, 2005

(54) CONVENTIONAL MECHANICAL LOCK CYLINDERS AND KEYS WITH ELECTRONIC ACCESS CONTROL FEATURE

(75) Inventors: Asil T. Gokcebay, Petaluma, CA (US); Yucel K. Keskin, Santa Clara, CA (US)

(73) Assignee: Security People, Inc., Petaluma, CA (US)

( * ) Notice: Subject to any disclaimer, the term of this patent is extended or adjusted under 35 U.S.C. 154(b) by 602 days.

(21) Appl. No.: 09/595,388

(22) Filed: Jun. 14, 2000

Related U.S. Application Data

(63) Continuation-in-part of application No. 08/705,843, filed on Aug. 30, 1996, now Pat. No. 6,552,650, which is a continuation-in-part of application No. 08/342,846, filed on Nov. 21, 1994, now Pat. No. 5,552,777, which is a continuation-in-part of application No. 07/836,206, filed on Feb. 14, 1992, now Pat. No. 5,367,295.

(51) Int. Cl.[7] ..... E05B 19/04
(52) U.S. Cl. ..... 340/5.65; 70/408; 70/278.2
(58) Field of Search ..... 340/5.65, 5.26, 340/5.33, 543; 235/382, 382.5, 472.03; 307/10.5, 10.2; 200/43.05; 705/55; 194/350; 70/395, 55, 408, 252, 278.2, 278.3

(56) References Cited

U.S. PATENT DOCUMENTS

| | | | | | |
|---|---|---|---|---|---|
| 480,299 | A | | 8/1892 | Voight | |
| 550,111 | A | | 11/1895 | Sargent | |
| 564,029 | A | | 7/1896 | Sargent | |
| 3,208,248 | A | | 9/1965 | Tornoe | |
| 3,733,862 | A | | 5/1973 | Killmeyer | |
| 3,797,936 | A | | 3/1974 | Dimitriadia | |
| 4,144,523 | A | | 3/1979 | Kaplit | |
| 4,148,372 | A | | 4/1979 | Schroeder | |
| 4,200,227 | A | * | 4/1980 | Lemelson | 235/382 |
| 4,209,782 | A | | 6/1980 | Donath et al. | |
| 4,257,030 | A | | 3/1981 | Bruhin et al. | |
| 4,326,124 | A | | 4/1982 | Faude | |
| 4,438,426 | A | * | 3/1984 | Adkins | 307/10.5 |
| 4,562,712 | A | | 1/1986 | Wolter | |
| 4,620,088 | A | | 10/1986 | Flies | |
| 4,642,631 | A | * | 2/1987 | Rak | 340/5.26 |
| 4,659,915 | A | | 4/1987 | Flies | |
| 4,663,952 | A | | 5/1987 | Gelhard | |
| 4,686,358 | A | | 8/1987 | Seckinger et al. | |
| 4,697,171 | A | * | 9/1987 | Suh | 340/543 |
| 4,712,398 | A | | 12/1987 | Clarkson et al. | |
| 4,723,427 | A | | 2/1988 | Oliver | |
| 4,732,022 | A | | 3/1988 | Oliver | |
| 4,789,859 | A | | 12/1988 | Clarkson et al. | |
| 4,823,575 | A | | 4/1989 | Florian et al. | |

(Continued)

FOREIGN PATENT DOCUMENTS

| | | | | |
|---|---|---|---|---|
| GB | 2291106 A | * | 1/1996 | E05B/49/00 |

OTHER PUBLICATIONS

Dallas Semiconductor DS1207 Timekey Specifications 1995.

*Primary Examiner*—Edwin C. Holloway III
(74) *Attorney, Agent, or Firm*—Thomas M. Freiburger

(57) ABSTRACT

A mechanical key and lock cylinder with mechanical bittings include electronic access control feature. A small, low-profile memory cell is embedded in a recess or hole through the key, with one cell terminal grounded to the key and the other having a contact extension. When the key is inserted into the keyway of the cylinder plug, the ground connection is made with the cylinder and the memory cell contact extension engages a contact of a connector unit from the cylinder plug. The key remains of very low profile. In another embodiment the key has its contacts on one or both sides of the key blade rather than at the shoulder of the key head. The memory cell device in or on the key head can include a microprocessor, battery and read/write memory.

26 Claims, 19 Drawing Sheets

U.S. PATENT DOCUMENTS 4,871,886 A * 10/1989 Vaughan et al. ..... 200/43.05
4,945,217 A * 7/1990 Bolan ..... 235/472.03
4,947,662 A * 8/1990 Imedio ..... 70/395
4,998,952 A 3/1991 Hyatt, Jr. et al.
5,003,801 A 4/1991 Stinar et al.
5,120,939 A * 6/1992 Claus et al. ..... 235/382
5,131,038 A 7/1992 Puhl et al.
5,140,317 A 8/1992 Hyatt, Jr. et al.
5,212,729 A * 5/1993 Schafer ..... 705/55
5,229,648 A * 7/1993 Sues et al. ..... 307/10.2
5,245,329 A 9/1993 Gokcebay
5,259,491 A * 11/1993 Ward II ..... 194/350
5,319,362 A * 6/1994 Hyatt, Jr. ..... 340/5.33
5,367,295 A 11/1994 Gokcebay et al.
5,461,218 A * 10/1995 Castleman et al. ..... 235/382
5,552,777 A 9/1996 Gokcebay et al.
5,749,253 A * 5/1998 Glick et al. ..... 70/278.2
5,768,925 A * 6/1998 Ozawa et al. ..... 70/408
5,771,722 A * 6/1998 DiVito et al. ..... 70/277
5,775,148 A * 7/1998 Layton et al. ..... 70/408
5,836,187 A * 11/1998 Janssen et al. ..... 70/252
6,609,402 B2 8/2003 Blankenship

* cited by examiner

CONVENTIONAL MECHANICAL LOCK CYLINDERS AND KEYS WITH ELECTRONIC ACCESS CONTROL FEATURE

This application is a continuation-in-part of application Ser. No. 08/705,843, filed Aug. 30, 1996, now U.S. Pat. No. 6,552,650, which was a continuation-in-part of application Ser. No. 08/342,846, filed Nov. 21, 1994, now U.S. Pat. No. 5,552,777, which was a continuation-in-part of application Ser. No. 07/836,206, filed Feb. 14, 1992, now U.S. Pat. No. 5,367,295.

BACKGROUND OF THE INVENTION

This invention relates to the use of existing mechanical locks with mechanical tumbler types of cylinders for electronic access control.

A number of access control systems have existed incorporating electrically operated locking devices with decision-making electronics for permitting access housed within the lock's trim, such as Touchcode system manufactured by Yale Electronics of Charlotte, N.C., Nova System manufactured by Kaba of Southington, Conn., and Solitaire System manufactured by Marlock of Chicago, Ill. Some of these access lock systems employ keypads, some cards, some purely electronic, magnetic or optic keys, and some employ mechanical keys equipped with electronic circuitry.

For the benefit of the current invention, distinction must be made between the purely electronic, magnetic or optical keys, mechanical keys, and mechanical keys equipped with electronic, magnetic or optical features.

A key comprised of purely electronic circuitry, magnetic or optical data storage and identification for access is an electronic key. In their use, the circuitry or recorded data is transferred to the reader means or reader recognizes the pattern held by the key optically. This key does not carry any mechanical cut configuration which is critical for granting access. These types of keys can be found in U.S. Pat. Nos. 3,797,936, Dimitriadis, granted Mar. 19, 1974; 4,209,782, Donath et al., granted Jun. 24, 1980; 4,257,030, Bruhin et al., granted Mar. 17, 1981; 4,620,088, Flies, granted Oct. 20, 1986; 4,659,915, Flies, granted Apr. 21, 1987; 4,789,859, Clarkson et al., granted Dec. 6, 1988. Mechanical keys are keys which activate a mechanical device through direct contact with the interpreting device, the tumblers. Based on the depth and placement configuration of the cut's meeting the tumblers and creating the proper alignment of such tumblers, access is granted. In most cases, once the proper alignment is established, the keyholder is able to turn the key to lock and unlock the locking device. However, in some cases, a push or pull action may be necessary for the locking and unlocking of the locking device. The aforementioned tumblers can be pin tumblers, lever tumblers, disk tumblers, rotary disk tumblers, or slider tumblers. Examples of mechanical keys may be found in U.S. Pat. Nos. 480,299, H. G. Voight, granted Aug. 9, 1892; 550,111, H. B. Sargent, granted Nov. 19, 1895; 564,029, H. B. Sargent, granted Jul. 14, 1896; 3,208,248, Tornoe, granted Feb. 6, 1963; 4,723,427, Oliver, granted Feb. 9, 1988; 4,732,022, Oliver, granted Mar. 22, 1988; 4,823,575, Florian et al., granted Apr. 25, 1989.

A mechanical key equipped with electronic circuitry, magnetic or optical data storage or optically recognizable features can be found in U.S. Pat. Nos. 3,733,862, Killmeyer, granted May 22, 1973; 4,144,523, Kaplit, granted Mar. 13, 1979; 4,326,124, Faude, granted Apr. 20, 1982; 4,562,712, Wolter, granted Jan. 7, 1986; 4,663,952, Gelhard, granted May 12, 1987; and 4,686,358, Seckinger et al., granted Aug. 11, 1987. See also Pat. Nos. 5,003,801, Stinar et al., 4,998,952, Hyatt et al., 5,131,038, Puhl et al., 5,140,317, Hyatt et al. and 5,245,329, Gokcebay. Keys shown in some of these patents carry the secondary element whether it is an electronic circuitry or some other type of coded data or recognizable pattern, in addition to its mechanically operating feature as described in purely mechanical keys. In some instances, both mechanical and no-nmechanical features of the key are used simultaneously for granting access and in some cases, these features are used independently. None of the patents discloses a key with built-in or built-on modular, self-contained, off-the-shelf memory cell formed in a can-like container as manufactured, for example, by Dallas Semiconductor.

The current invention relates to the conversion of mechanical lock cylinders and keys for electronic use without altering their mechanical functionality, as well as to a simple cylinder and a key fitted with electronic components, particularly to a key fitted with a self-contained memory unit in the key head, with one wire bus connection to a contact for connection to a lock or reader. As mentioned above, keys and cylinders employing other electronic or other non-mechanical features, as well as mechanical features, exist. In these existing types of systems, a keyholder will insert his/her key carrying electronic circuitry with contact means into the key receiving cylinder employing a matching contact means and, upon this insertion and sometimes insertion and turning, a contact will be made with the reader unit transferring the access information into the lock's decision making unit. This decision making unit is usually housed within the lock's trim plate. Upon the decision to grant access, the unit will electrically unlock the locking mechanism or allow the key to turn and retract the latch bolt of the lock.

These systems employ complicated and expensive circuitry and contact means, thus requiring special manufacturing of both cylinder and key.

The objective of the current invention is to provide a simple method of conversion that applies to any mechanical key and cylinder combination for their use in electronic access control systems; and to the mechanical key itself, efficiently fitted with a memory cell in a standardized Dallas Semiconductor can-like container, and this can be more than a memory cell and may include microprocessor, battery, read/write memory, etc.

A simplified approach is taken to the reader and the key connection by the present invention described below. In a preferred embodiment, the existing lock cylinders and keys are simply modified (or the same type of lock and key are OEM fitted) to become a part of an electronic access control lock while still maintaining their mechanically operating status. In the case of the key itself, it can take several forms as to the contact for the one wire bus connection, but in each case the key has a memory cell of the type described, fitted into the key head.

SUMMARY OF THE INVENTION

The Key

The mechanical key is fitted with a memory cell employing one wire bus communication protocol such as ones made by Dallas Semiconductor models DS1990, DS1991, DS1992, DS1993 and DS1994, having a conductive metal casing with an isolated data terminal. These cells are fitted into the key's head area by opening a hole on the key's head the same size as the cell's diameter for a tight fit contact. In another preferred embodiment, the hole for the memory cell may not be drilled all the way through, leaving metal at the bottom of the cavity for better contact due to the small size of the cell, there is adequate space in the key's bead for its normal mechanical functions and other capabilities, i.e. shoulder stops, key-ring hole, etc. Preferably a plastic cover is included over the key's head. The key can also be made as an OEM product, formed with the hole or recess, fitted with the memory cell and then enveloped with the plastic cover.

By inserting the memory cell into the key, the ground contact between the cell and the key is established. The data communication is provided by a small metal probe or contact extension contacting the other terminal or data end of the cell and extending toward the key cut, most of it covered by the outside plastic cover. While one end of this probe is making contact with the data end of the cell, the other end lies generally flush with the key shoulder (which limits movement of the key into the lock cylinder). The probe is within the outside cover but in such a way that upon insertion of the key into the key plug it will come in contact with the isolated contact located on the receiving plug. In another embodiment, the memory cell or cell unit carrying a microprocessor is not grounded to the metal of the key, but two isolated conductors extend to a position on the key where two contacts are located, still in a one wire bus connection. The contact or contacts can be either at the key shoulder, facing toward the cylinder plug as described or on the key blade, on one or both sides of the blade. The probe can be spring loaded in the key while the receiving contact is fixed, or both could be spring loaded or otherwise biased.

The Isolated Contact

This unit consists of a spring-loaded contact, preferably 22 gauge ordinary electrical wire and heat shrink tubing. The spring-loaded contact is the type that is commonly used in the testing of electronic circuitry like those made by Interconnect Devices, Inc. The outside diameter of this contact is about 0.054". The heat shrink tubing is also commonly used and available for insulation purposes. In the preferred embodiment, the wire is soldered to the back end of the contact, then they are both inserted into the heat shrink tubing leaving a small portion of the contact exposed. In another preferred embodiment, a female connector may be soldered to the back end of the contact to facilitate hook-up to the circuitry. The unit is then heated and the heat shrink tube insulates the contact and the wire creating the connector unit. The unit is now ready to be inserted into the cylinder plug. In another preferred embodiment the isolated contact is a solid piece of wire insulated by heat-shrink tube or other type of insulating material. In automotive applications the isolated contact may comprise a flat wire as a leaf spring, biased inward toward the keyway and located in a housing in front of the cylinder plug (rather than in the plug itself), as in some General Motors vehicles.

The Cylinder Plug

In accordance with one preferred embodiment of the present invention, a small hole is drilled along the length of the cylinder plug at the side of its keyway, without interfering with its mechanically operating pins, wafers, disks, side-bars or sliders, etc. The isolated contact unit is then inserted and secured into the above-mentioned hole. The spring loaded tip of the isolated contact unit extends from the plug surface approximately 0.015" to establish contact with the key's probe. The other end of the isolated contact unit carrying communication from the key is sent to a processor board for processing of the data. The body of the plug, cylinder and lock body thereof, serves as the ground part of the communication. This comprises a single-wire bus communication protocol.

In another preferred embodiment, the lock cylinder may be of a high security type, such as ones manufactured by Medeco Security Locks. Assa, Schlage Primus line, etc. High security lock cylinders generally employ secondary locking principles to achieve further security. The employment of these principles does not interfere with the present invention nor the present invention interfere with the above mentioned additional locking principles, making the method applicable to virtually any type of mechanical locking cylinder available in the marketplace today. There is also no interference with the cylinder's cam unit, allowing normal mechanical functionality.

Upon insertion of the key into the cylinder plug, the probe makes contact with the connector unit located on the plug and transmits the data. These cell units are available with preprogrammed memory carrying identification number data, as well as read and write memory, allowing many applications, such as cells carrying data about the keyholder such as name, PIN number, access code, biometric template (e.g. fingerprint, retina scan, voice print), etc. The memory cell preferably is password protected, so that only authorized persons can have access to the data contained in the memory cell.

In some embodiments the memory cell contains a microprocessor, battery and read/write memory, providing encryption capabilities, other security identification, and individualized keyholder preferences such as, in automobile applications, seat, mirror and radio adjustments, by interacting with a processor and data bank in the vehicle. Additional functions that may be achieved include radius of travel, speed of travel, distance of travel, times of travel, etc. For example, a parent can regulate when a child can drive, how far and at what speed, etc.

No complex key blank, lock cylinder or plug manufacturing is necessary in principal embodiments of the present invention, which use keys and cylinders manufactured by all major lock manufacturers, i.e. Schlage, Yale, Corbin, Russwin, Arrow, Assa, Sargent, Medeco, Falcon, etc. In another embodiment one or two key contacts are found on the sides of the key blade, and this can be similar to the automotive keys made by Strattec Security Corporation (Milwaukee, Wis., U.S. Pat. No. 4,148,372). In that case, the lock cylinders fitted with a front cover which reads the blade side contacts.

When the key is used for access control purposes, it may not have the mechanical configurations necessary to operate the lock cylinder in which it is being inserted. It may, however, be able to operate other locks within the facility where access control or high security is not required, and the keyholder is allowed to enter by using the mechanical feature of his/her key. The locks that are fitted with the access control system will still have the mechanical by-pass capability. These locks may, for example, be keyed to the grand master key. This feature can be handy if the electronics of the lock fail. In another embodiment the lock cylinders will all be fitted with secondary locking mechanisms that usually exist in high security cylinders such as side bittings that operate a locking side bar. In these types of systems generally all the side bittings on all of the operating keys are the same; therefore, the key will operate these side bittings mechanically while also providing electronic access to the cylinder. The regular tumbler bittings may be used for access to purely mechanical cylinders. In another embodiment the key may not have any mechanical bitting configuration but a shape that will allow an insertion to the receiving device. In this case the key will only be used as an electronic access device. The key may have a bump or a dimple or some other form of locator/registry feature that may also act as a key retainer once inserted and turned (if design requires turning).

Since the key contains both a memory cell containing access control data and mechanical bittings, it can be used for accessing both high and low security areas. The mechanical bittings will allow the user to access areas where time and date control for access is not required, thus making it a low security area, and the electronically stores access control data can be used in locks (areas) employing time and date control, thus making it a high security area.

The above aspects relative to higher and lower security points and biometric featured encoded on the key are similar in some respects to the system disclosed in co-pending application Ser. No. 343,663, filed Apr. 27, 1989, now U.S. Pat. No. 5,245,329 and the disclosure of that application is incorporated herein by reference.

DESCRIPTION OF PREFERRED EMBODIMENTS

Figure 1:
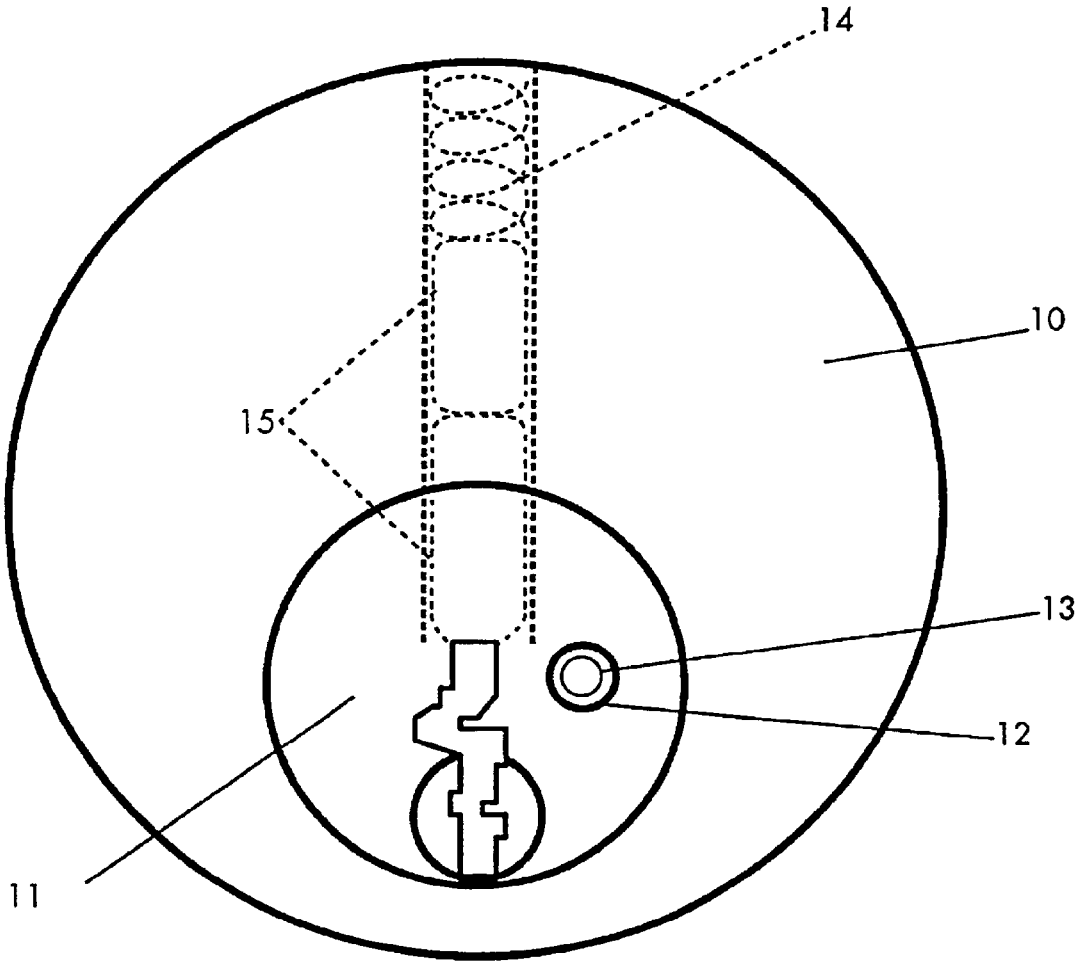
FIG. 1 shows a front view of a mechanical mortise cylinder fitted with the conversion means.

In the drawings, FIG. 1 shows the front view of a mortise type cylinder 10. The cylinder plug 11 contains a hole 12 on The side of its keyway in such distance from the keyway where it does not interfere with the pinholes 14 and pins 15 working inside the pinholes 14. A connector unit is in the hole 12, electrically insulated from the metal of the plug.

Figure 2:
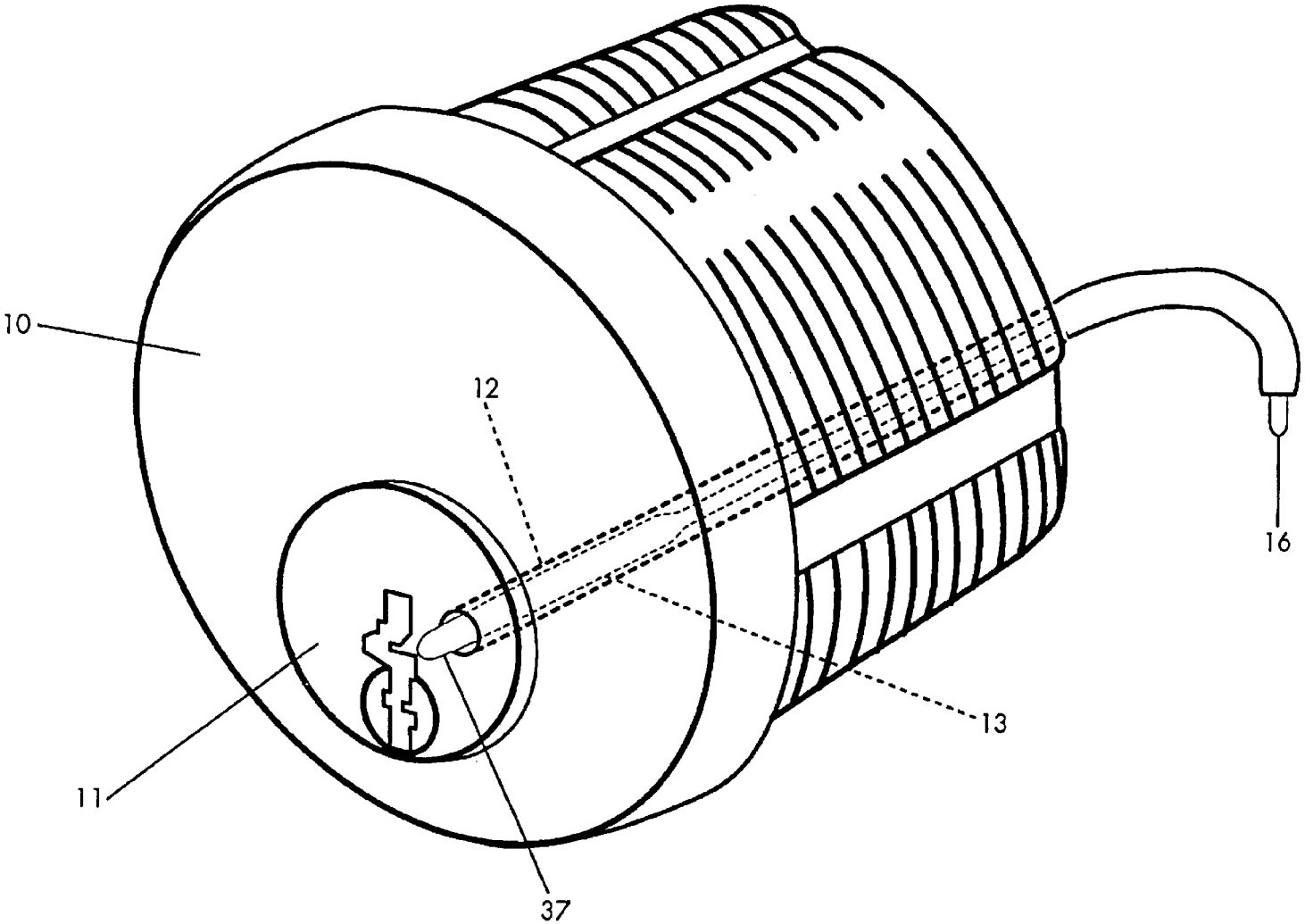
FIG. 2 is a perspective view of the same cylinder.

FIG. 2 shows the same cylinder in perspective, including the connector hole 12 inside the cylinder plug, and the connector unit 13.

Figure 3:
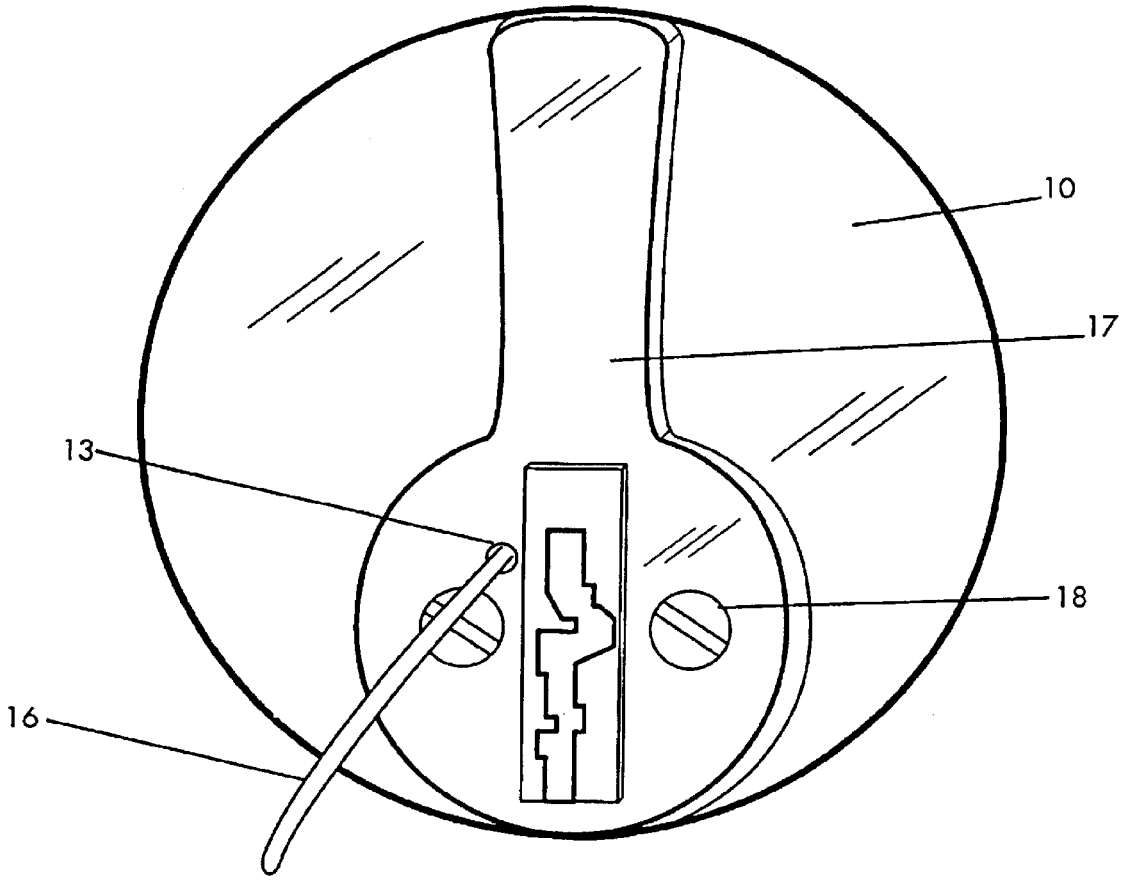
FIG. 3 is a rear view of the same cylinder with the wire ready for connection.

FIG. 3 shows the rear view of the cylinder 10, with the cam/tail piece 17 attached to the cylinder plug by screws 18, and the rear end of the connector hole 12 with the wire end of the connector unit 13. A wire 16 extends from the connector unit.

Figure 4:
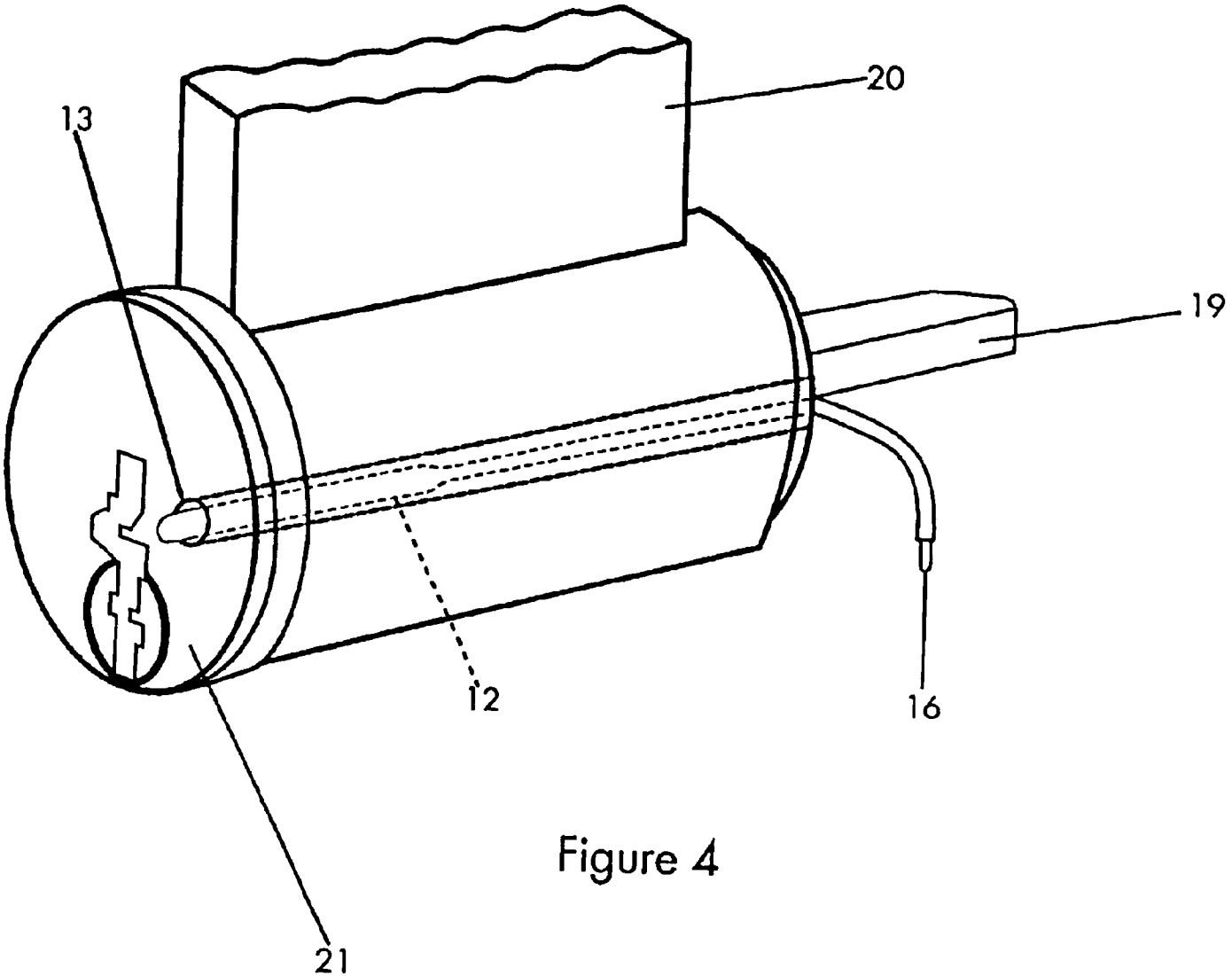
FIG. 4 shows a side view of a mechanical key-in- knob type cylinder fitted with a conversion means.

FIG. 4 shows in perspective a key-in-knob type cylinder equipped with the connector means. The plug 21 inside the cylinder 20 (the pin-holding portion is shown) is equipped with the connector hole 12 and the connector unit 13. The tail/cam piece 19 is attached to the plug 21, with the wire end of connector unit 13 coming out of the rear end of the cylinder 20.

In all types of cylinders, the wire end of the connector unit 13 comes through the plug unit, therefore there is no interference when the cylinder plug turns by use of purely mechanical action. The connector unit turns with the plug, causing no interference to its mechanical operation.

Figure 5:
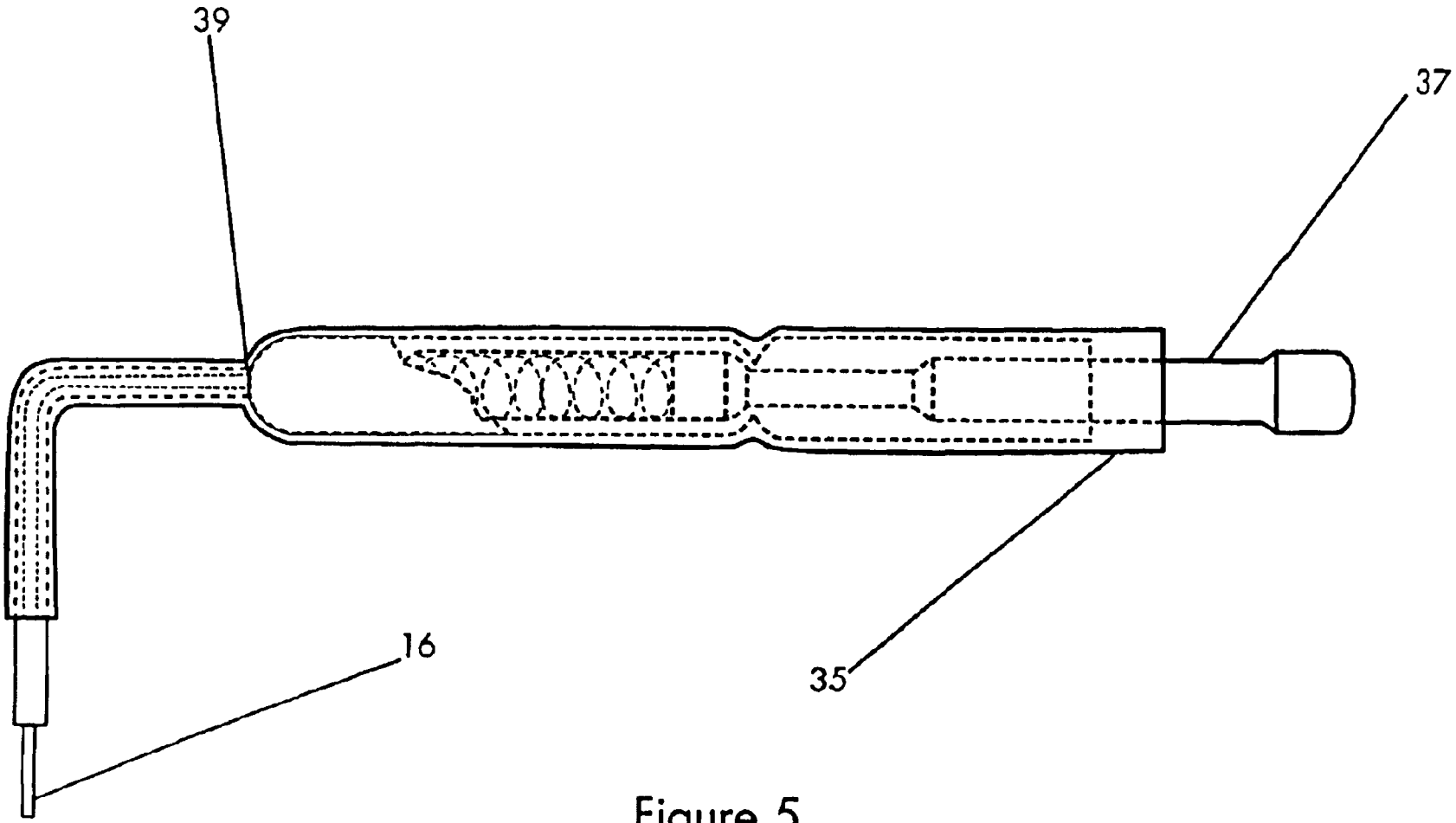
FIG. 5 shows an assembled connector unit. The hole 12 is equipped with the connector unit 13.

FIG. 5 shows the assembled connector unit 13. The spring loaded connector head 37 is soldered to the wire 16 at 39. They are then housed by the insulative heat shrink tube 35. When covered by the heat shrink tube 35 there is sufficient space at the connector head 37 for making contact, i.e. the connector head extends out from the tube 35 and from the plug, when installed.

Figure 6:
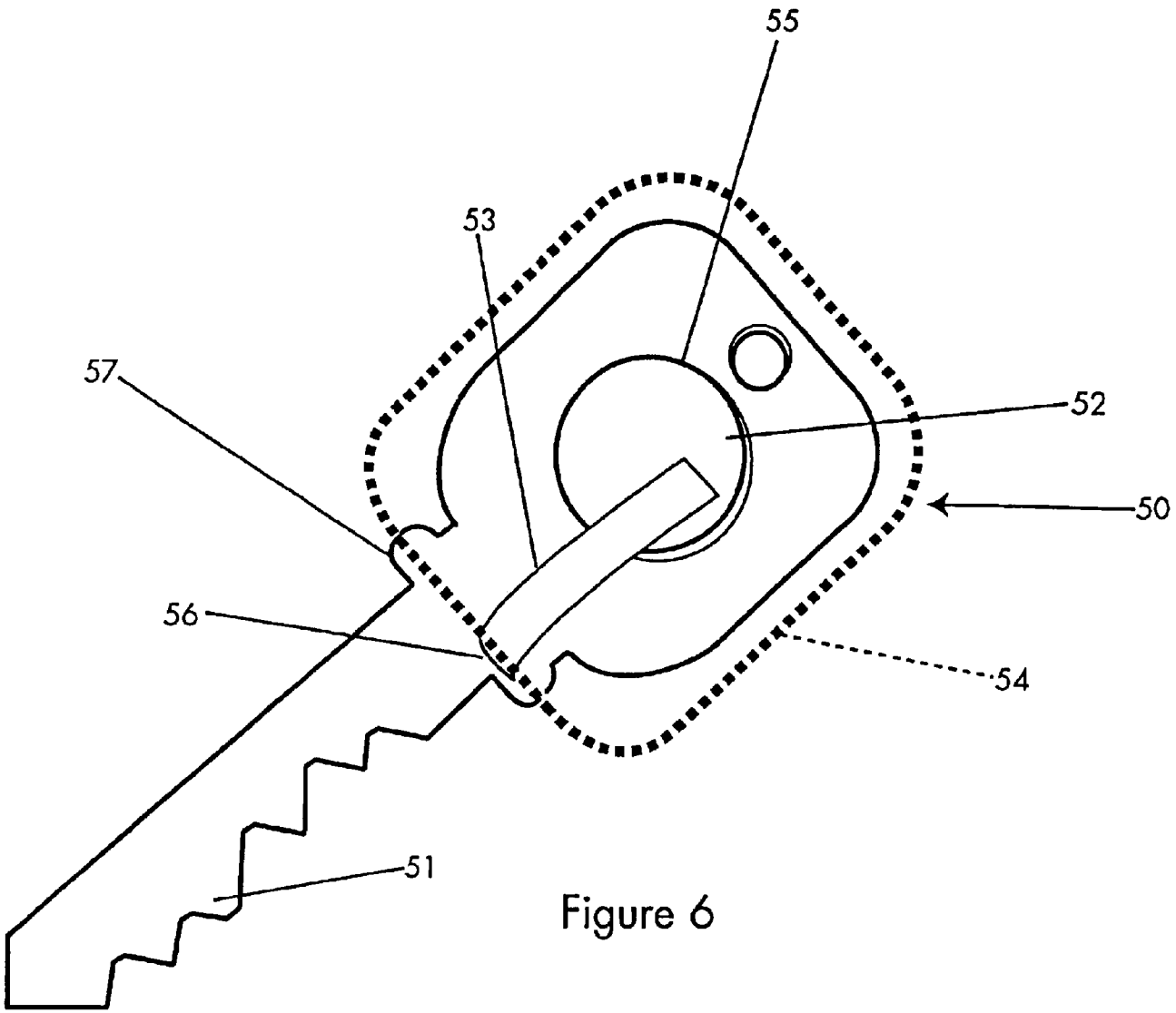
FIG. 6 shows a mechanical key fitted with the memory and contact means.

FIG. 6 shows mechanical key 50 having a mechanical cut configuration 51 fitted with a memory cell 52 into its cavity 55. The outside plastic cover 54, shown in dashed lines, contains the contact probe or contact extension 53 which upon closure of the cover over the key makes contact with the memory cell 52. The other end or tip 56 of the probe 53 is lined up with the shoulder of the key 57. When the key 50 is inserted into the receiving cylinder, the key-probe 53 makes contact with the cylinder connector unit, i.e. with the spring loaded connector head 37.

Instead of being a part of the plastic cover, the contact probe 53 can be permanently secured to the data connection terminal (e.g. by soldering) of the memory cell 52.

Figure 7:
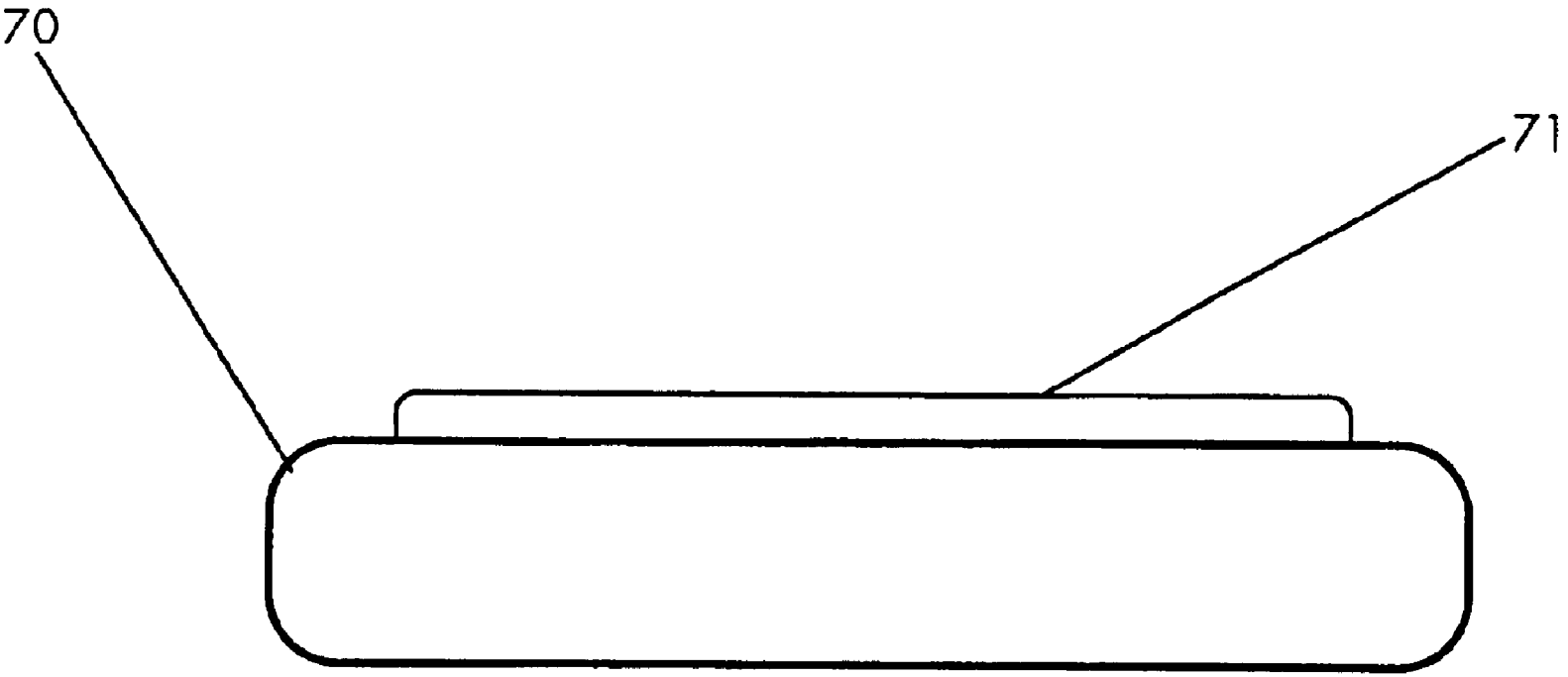
FIG. 7 shows a picture of the memory cell employing one wire bus communication protocol.

FIG. 7 shows the single wire bus type memory cell 52. Item 70 is the ground connection and item 71 is The data connection, the two terminals of the cell. This comprises a single-wire bus communication protocol.

Figure 8:
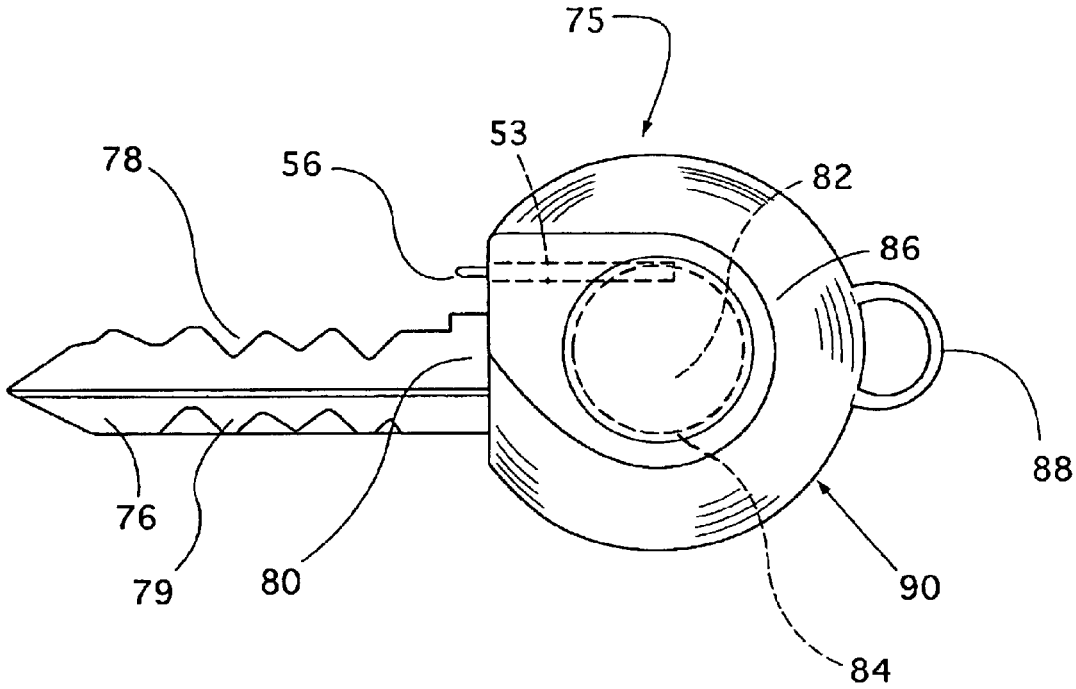
FIG. 8 is a view showing a slightly modified form of key, similar to the key of FIG. 6 which includes secondary bittings.
Figure 8A:
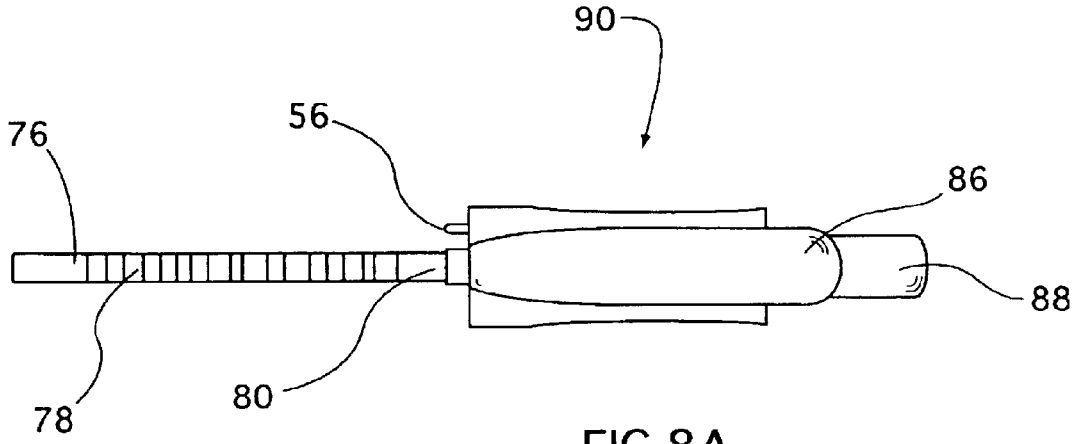
FIG. 8A is a profile (top) view of the key of FIG. 8.

FIGS. 8 and 8A show a key 75 which is conceptually the same as the key shown in FIG. 6. The key 75 has a forward contact 56 generally from the shoulder of the key and positioned to engage on a mating contact of a lock cylinder or reader, and the key also has a blade 76 with a key cut configuration 78 and optional secondary cut configuration 79. The data contact 56 at the shoulder 80 of the key extends back via a conductor 53 to make contact with the data side 82 of a memory cell 84, which may be a memory cell as made by Dallas Semiconductor, including the models noted above, or which can be a more complex device, with microprocessor, battery, read/write memory, etc., often called an iButton. A plastic cover of the key head is shown at 86, and this can include a loop 88 for a key ring with the memory cell/iButton 82 nested closely against the metal of the key head 90, preferably closely fitted within a recess or hole in the metal key head. The key head 90 can be of slender configuration, a comfortable size for gripping and turning in a lock, as shown in FIG. 8A. In a preferred embodiment the plastic cover 86 has a dished-in configuration as shown in FIG. 8A, which tends to be comfortable to use.

Figure 8B:
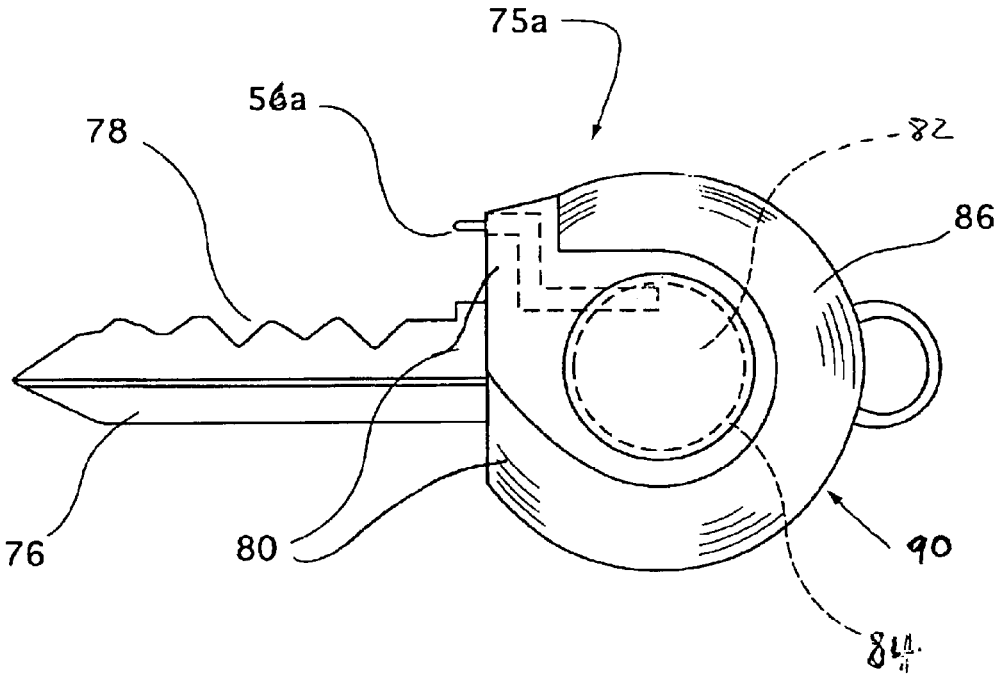
FIG. 8B is a side view of a key again similar to FIG. 6 but having a data contact in a slightly different position.
Figure 8C:
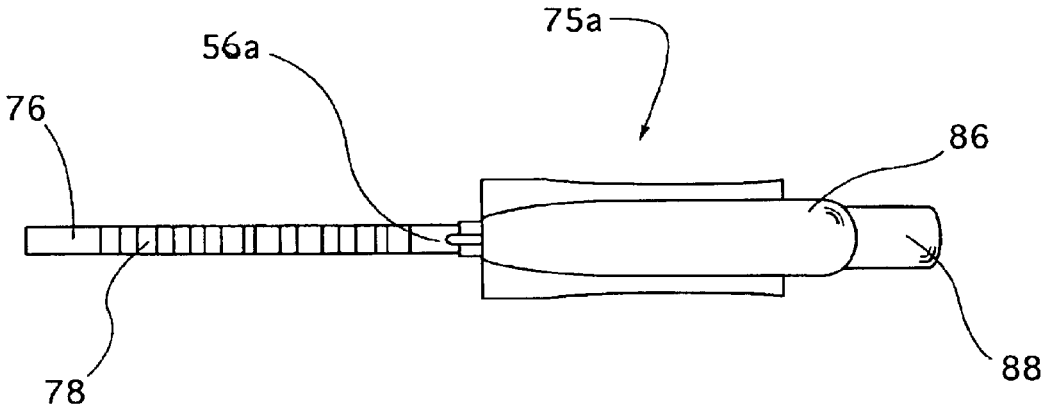
FIG. 8C is a profile view of the same key.

FIGS. 8B and 8C show a key 75*a* which is very similar to the key 75 of FIG. 8 but with a data contact 56*a* in a different position on the key shoulder 80. In this case the contact 56*a* is located radially outwardly from the rotational axis of the key, for making contact with a mating contact which is farther removed from the key slot. As shown in FIG. 8C, this contact 56*a* can be centered relative to the key blade, if desired. It could also be offset to left or right if desired.

Figure 8D:
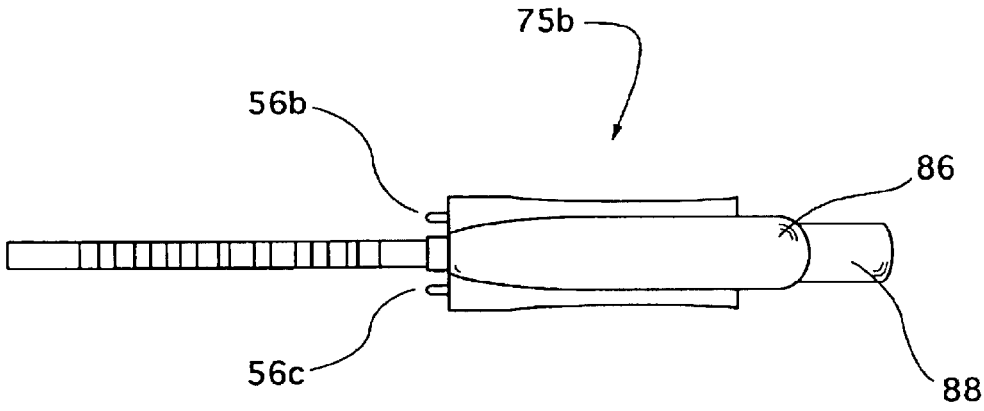
FIG. 8D is a view similar to FIG. 8A but showing a key with both data and ground contacts positioned at the key shoulder.

FIG. 8D shows a similar key to that of FIGS. 8 and 8A, but with two contacts 56*b* and 56*c* on the shoulder 80 of the key 75*b,* rather than a single data contact. This can be in the case where the memory cell or self-contained microprocessor device as described above is not grounded to metal of the key, such as where the key is not of conductive metal or where the plastic casing 86 alone is employed to retain the memory cell or to provide a dedicated ground contact or simply as a design choice. Thus, two conductors are then needed for contact with a lock or keyreader, one connected to the data side of the memory cell and one to the ground side, thus the two contacts 56*b* and 56*c*.

Figure 8E:
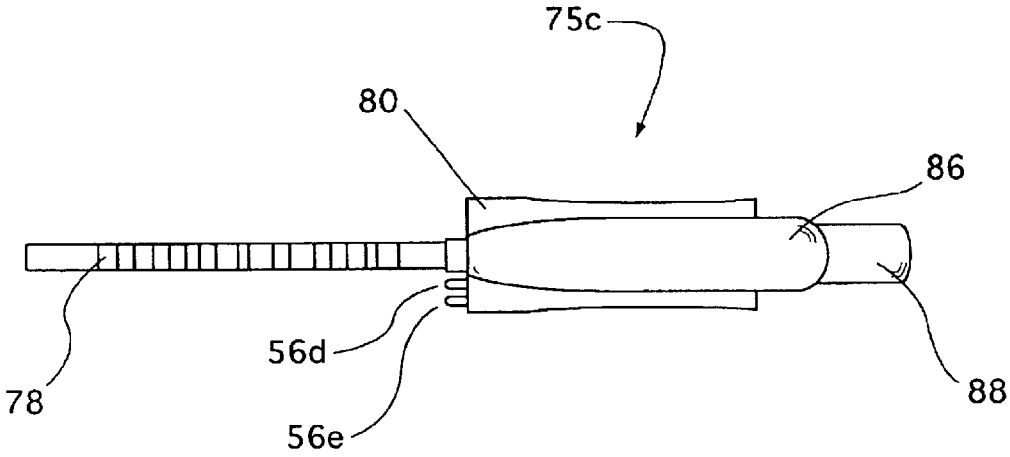
FIG. 8E is a view similar to FIG. 8D but with a variation on the contact position.
Figure 8F:
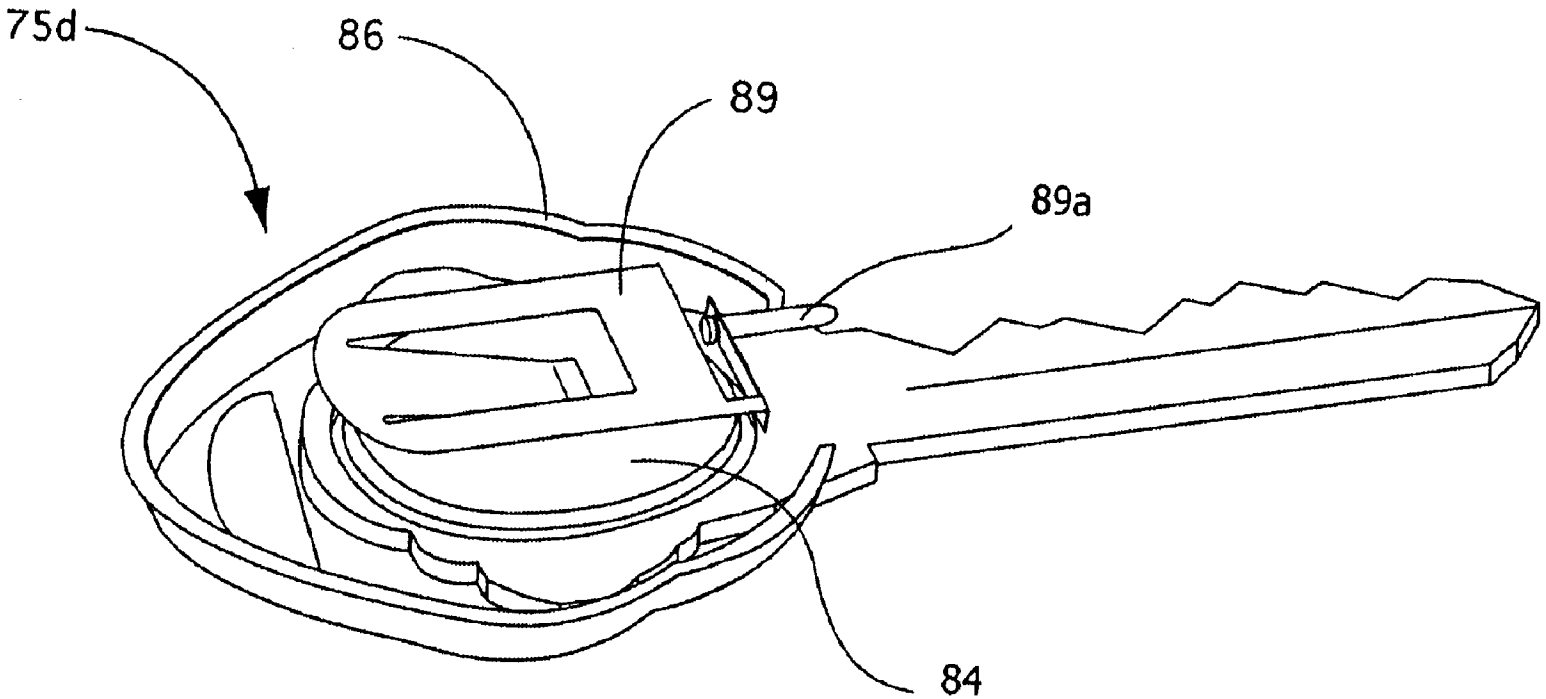
FIG. 8F is a perspective view of a key with its data connection components.

FIG. 8E shows a key 75*c* with a further variation at the two contacts, now identified as 56*d* and 56*e,* are at one side of the key shoulder 80. These contacts can either be at the left side or the right side, for mating with appropriately positioned contacts in a lock cylinder or other keyreader. FIG. 8F shows a key 75*d* with a stamped spring data contact 89 and pin 89*a*. The spring data contact 89 slips over the pin 89*a* with a tight press fit and provides spring action so that the pin is biased against the receiving contact. The spring contact 89 also provides positive pressure against the memory cell 84 for good contact. The key is encapsulated by the plastic cover 86 which may be two pieces bonded together to create the housing.

Figure 8G:
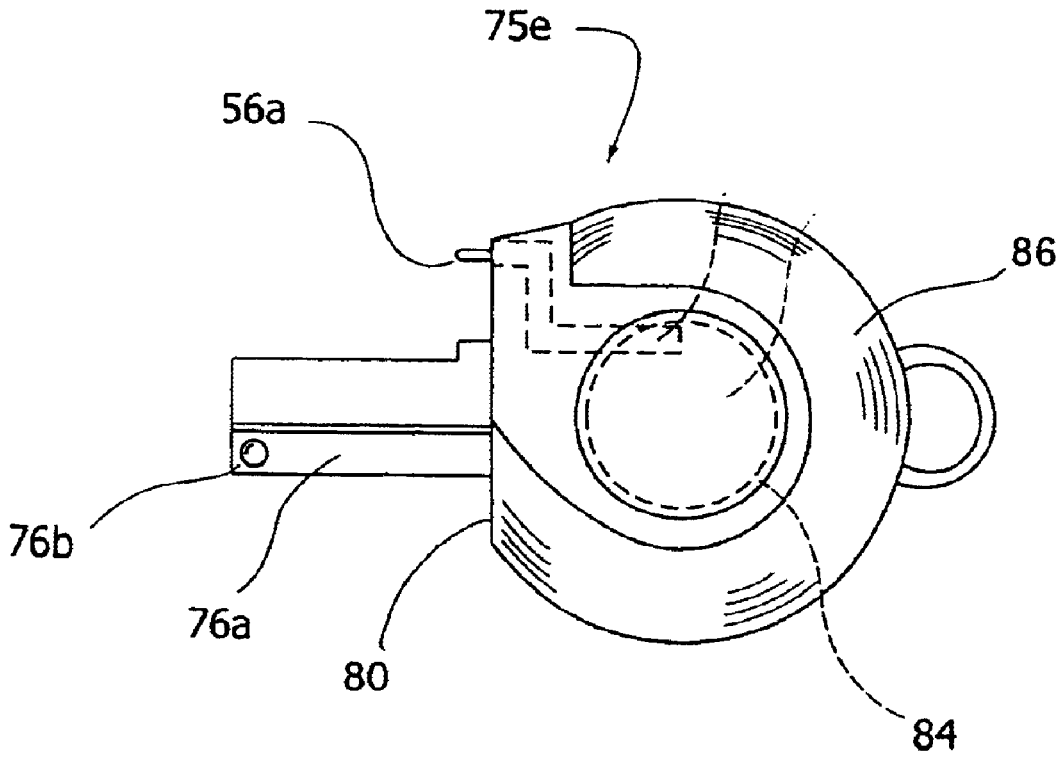
FIG. 8G shows a key similar to FIG. 8B but without the usual bittings.

FIG. 8G shows a key 75*e* which is purely an electronic access key, except that the key has a blade 76*a* that can be used for turning the plug of a lock cylinder. The blade 76*a* is without mechanical bittings but with a shape that will allow insertion into a receiving device. The key blade 76*a* has a bump or dimple 76*b* or some other form of locator or registry feature that may also act as a key retainer once the key 76*e* has been inserted and turned, in key receivers requiring turning.

Figure 8H:
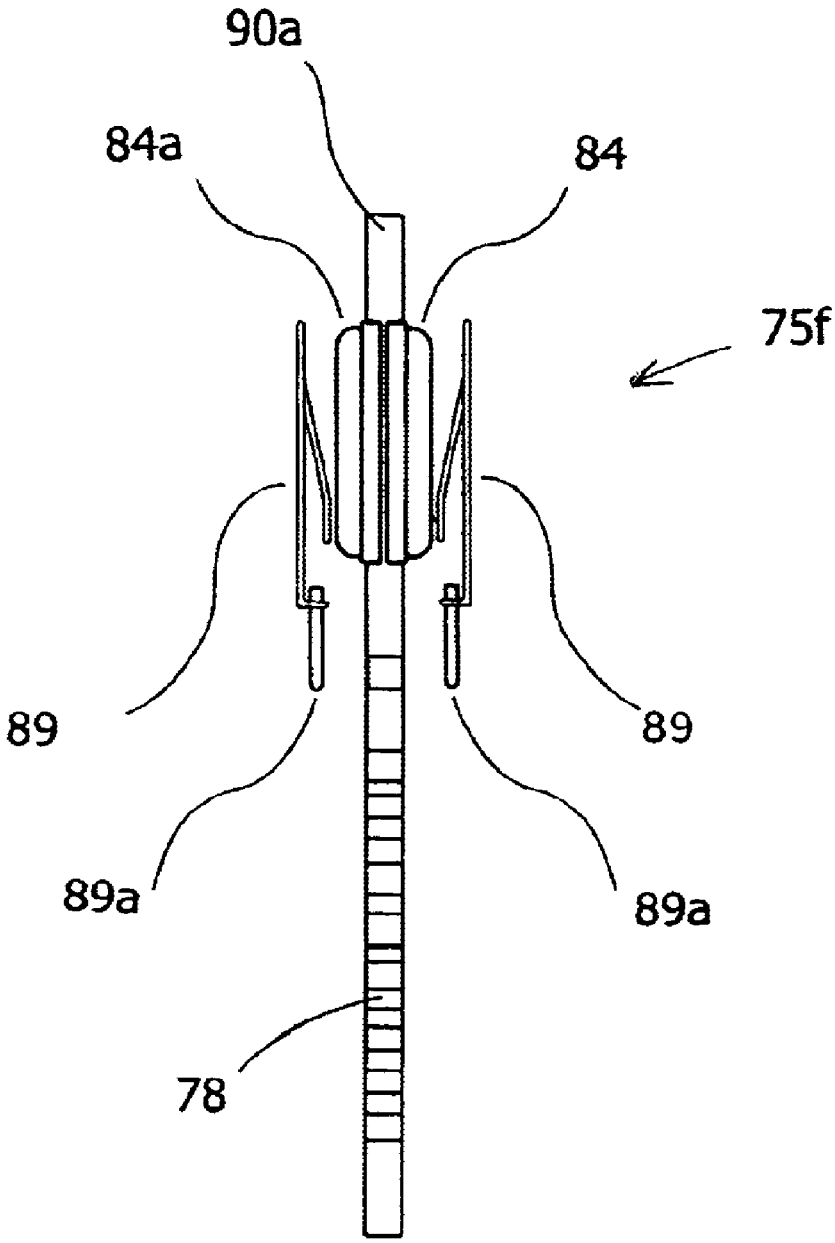
FIG. 8H is a top view of a key having two memory cells or a memory cell and another device.

FIG. 8H shows in top view a key 75*f* which has two memory cells/iButtons 84, 84*a,* and these may be positioned back to back in the key head as shown. The second cell 84*a* could alternatively comprise a battery, for providing greater battery power. However, in the configuration shown, two memory cells preferably are secured in or on the key head 90*a,* and the data sides of these cells are contacted by stamped leaf spring contacts 89 in the manner discussed previously. Spring contacts 89*a* extend into position to engage with a lock contact, as also discussed above. FIG. 8H illustrates that the invention contemplates two (or possibly more) memory cells or other similarly-sized can-like devices in or on the key head when this is needed or will provide better performance, further functions, etc.

Figure 9:
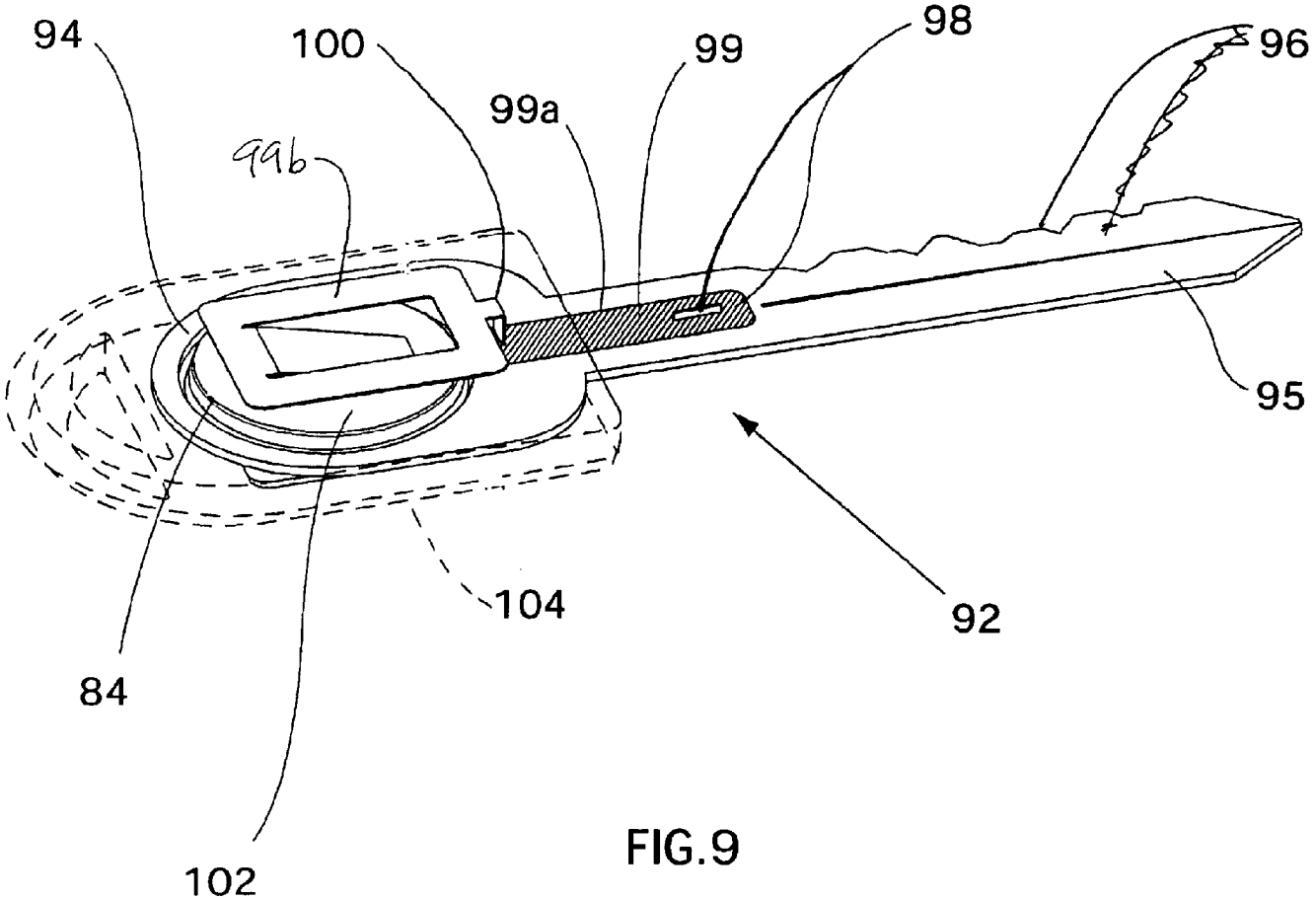
FIG. 9 is a perspective view of a key which may be an automotive key, with an isolated data contact on the side of the key blade.

FIG. 9 shows another form of key 92. The key 92 again has a key head 94, blade 95 and mechanical key cut configuration 96. A memory cell or iButton device 84 is secured to the key head, preferably with the ground side of the two-pole can grounded against the metal of the key. In this case, however, the data contact is not positioned to project from the key shoulder, but instead is located in the key blade at 98, preferably just back from the end of the key cuts 96 toward the head. Such a data contact is generally as shown in U.S. Pat. No. 4,148,372 referenced above. However, that patent describes the similarly-located contact as a resistance element, whereas in the present invention the element 98 is a data contact. An isolated conductor 100 leads from the contact 98 back to the data side 102 of the memory cell or iButton. As in the earlier described keys, the key 92 has a plastic covering 104 over the key head.

Figure 9A:
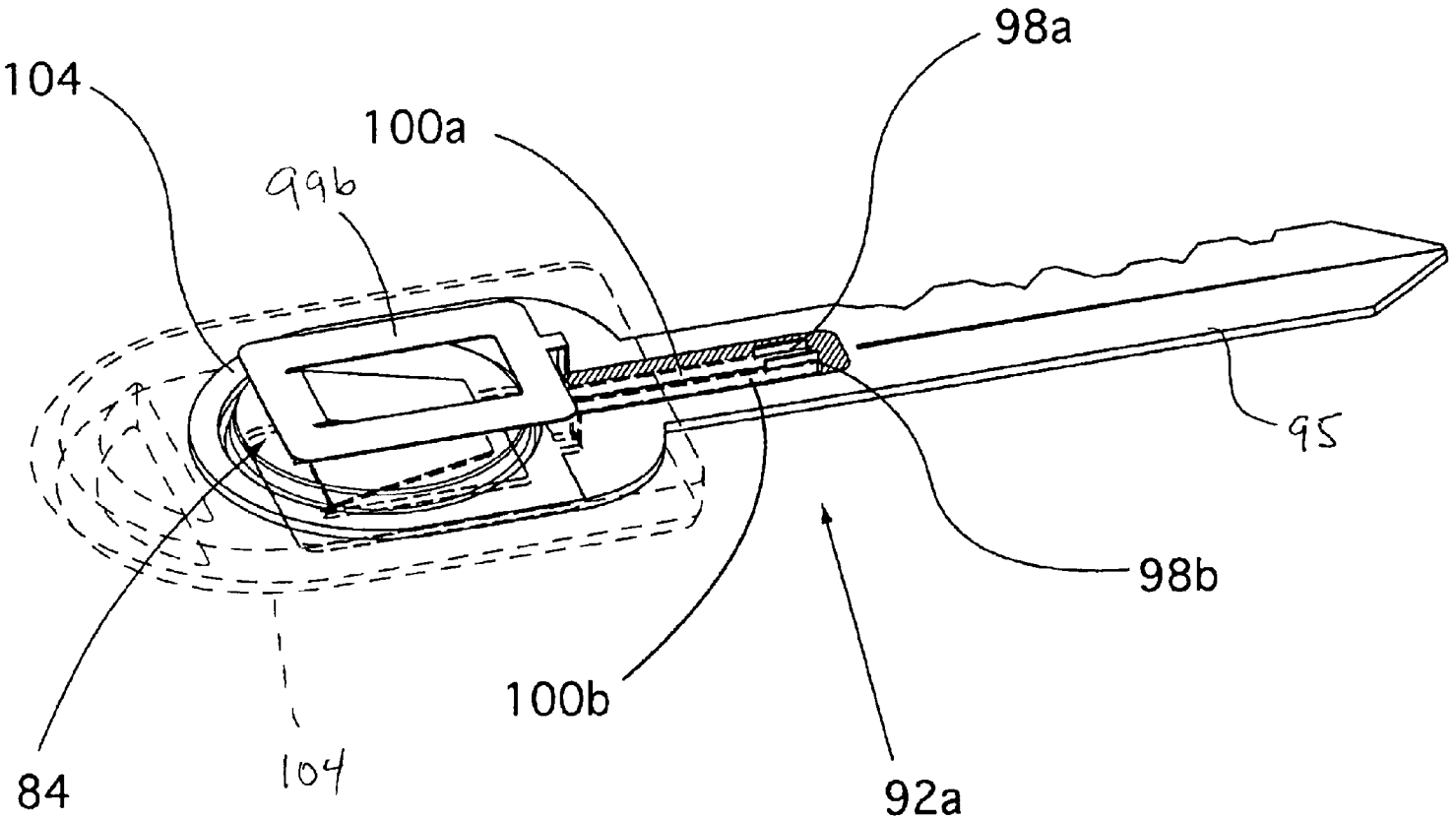
FIG. 9A is a perspective view of a key similar to FIG. 9, but with two isolated contacts on the key blade.

FIG. 9A shows a variation of FIG. 9, wherein the key blade 95 has two contacts 98*a* and 98*b* for making conductive contact with a lock cylinder apparatus or key reader. As above, this is usually for the case where the memory cell or iButton 84 is not grounded to conductive metal of the key, but rather has a data side conductor 100*a* and a ground side conductor 100*b,* both isolated and connected to the contacts 98*a* and 9B*b*. In some instances the contacts 98*a* and 98*b* may be the data connection of two different memory cells (as in FIG. 8H) providing different functionality, or while 98*a* is providing data connection, 98*b* may provide connection to a watch-type battery (similar size as the memory cell) to supply additional power.

The keys 92 and 92*a* shown in FIGS. 9 and 9A generally are for automotive use. For that purpose, the automobile ignition may be fitted with a shroud (not shown) which is not actually part of the lock cylinder but which is slightly back (toward the driver) from the lock cylinder and positioned to make contact with the data contact 98 (or 98*a,* 98*b*). The data contact 98 can is be exposed at only one side of the key blade or at both sides, for reader contact redundancy. Note that the two-contact version of the key 92*a* can be modified such that one contact 98*a* is on the left side of the blade and the other contact 98*b* is on the right side of the blade. This is determined by the design of the reader element, whether it is desired to have both reader contacts on one side or one on each side, etc. FIG. 9 shows a plastic insulative insert 99 for the key, preferably press-fit into a hole or recess 99*a* in the key and within which the contact 98 is embedded or contained and extends out as a contact. A flat spring conductor 99*b* connects the data side of the memory cell 84 to the back end of the contact 98.

Figure 10:
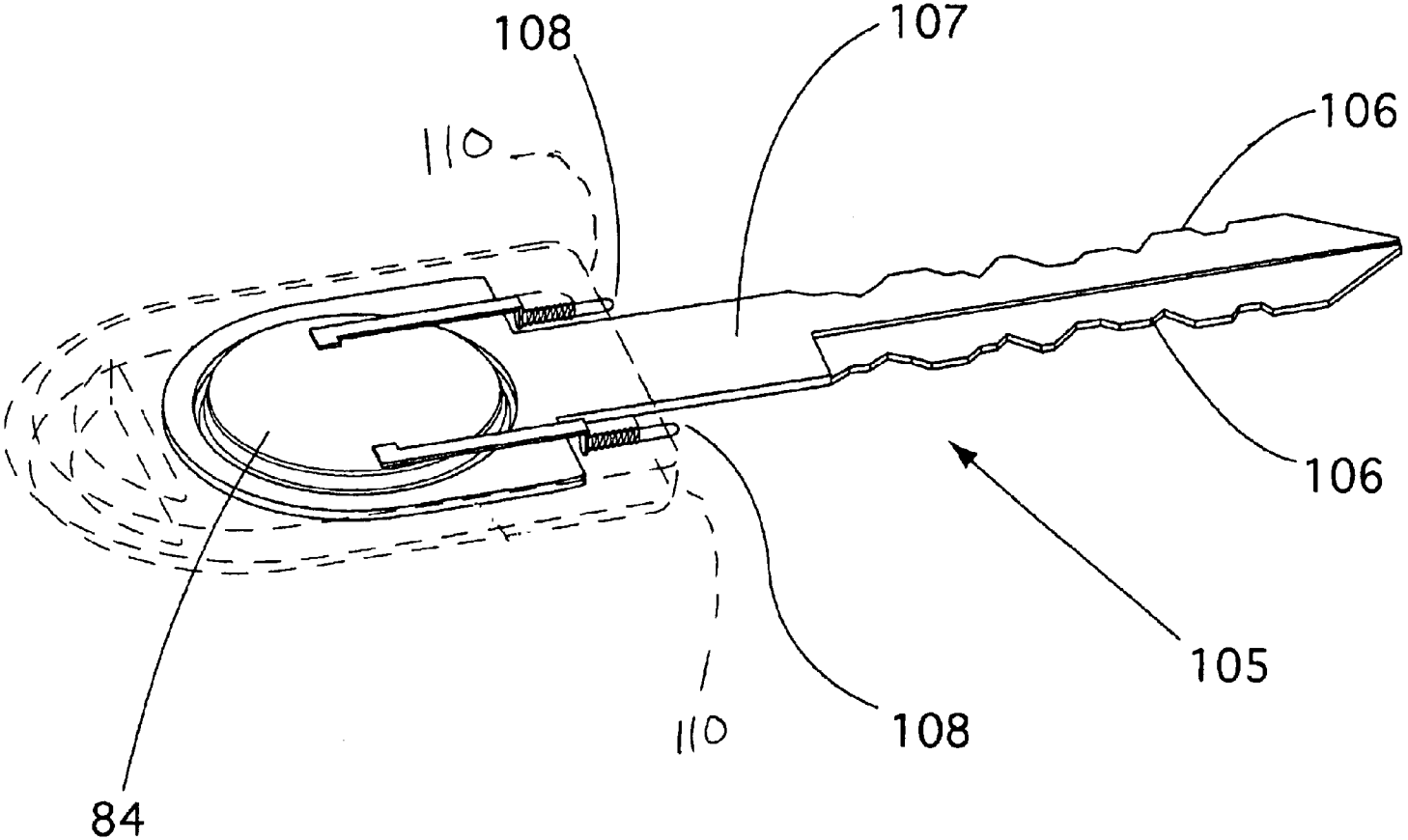
FIGS. 10, 10A, 10B and 10C are perspective views of reversible keys having contacts in different positions for reversible function, including contacts on the shoulders of the keys and contacts on the key blades.

FIGS. 10, 10A, 10B, and 10C show additional automotive keys 105, 105*a,* 105*b* and 105*c,* in this case reversible keys that can be used in either of two 180°-opposed orientations. These drawings show schematically several different schemes for location of the contact or contacts for communication to and from the memory cell (iButton) 84 contained in the key head. As shown in all these schematic drawings, the key cuts 106 are identical on both sides of the key blades 107 and thus the keys are reversible. In FIG. 10 identical data contacts 108 are located in similar positions on the shoulders 110 of the symmetrically shaped head. Each data contact is the same, being connected to the data side of the memory cell device 84 (in the claims, the term "memory cell" is intended to refer to any of the devices described above, including an iButton having microprocessor, battery, read/write memory, etc.).

Figure 10A:
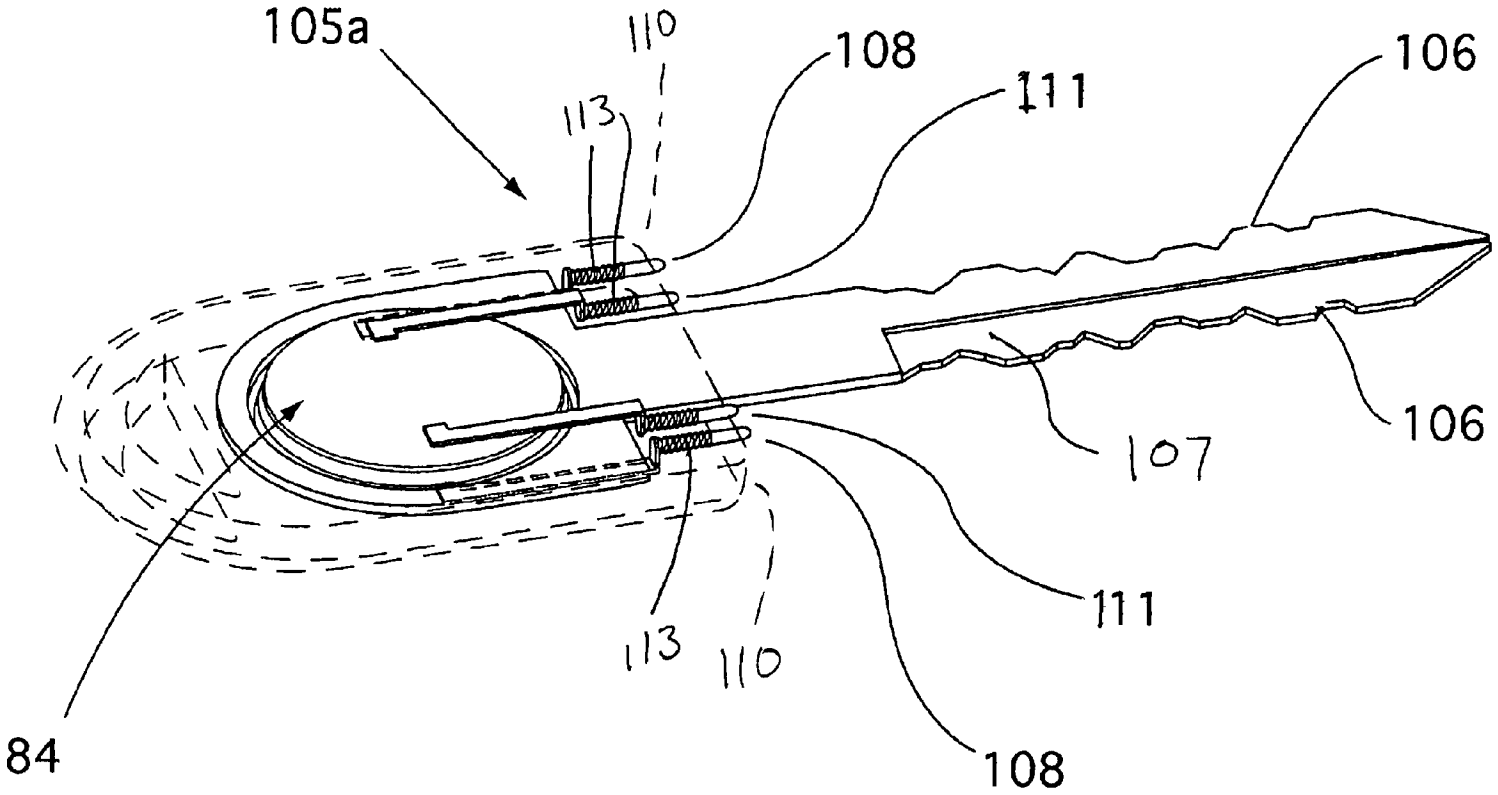

In FIG. 10A, both a data contact 108 and a ground contact 111 are located at each opposing shoulder 110 of the reversible key 105*a,* in similar and symmetrical positions. The two contacts are provided for cases similar to those described above, where it is not desired to ground the ground side of the memory cell 84 to conductive metal of the key, or one may be providing data and the other battery power from an additional cell similarly shaped as an iButton or a watch battery. Alternatively, two memory cells may be employed and the contacts 108, 111 may provide connection to these cells separately. Compression springs 113 are shown for urging the contacts 108, 111 into secure electrical contact with the data reader.

Figure 10B:
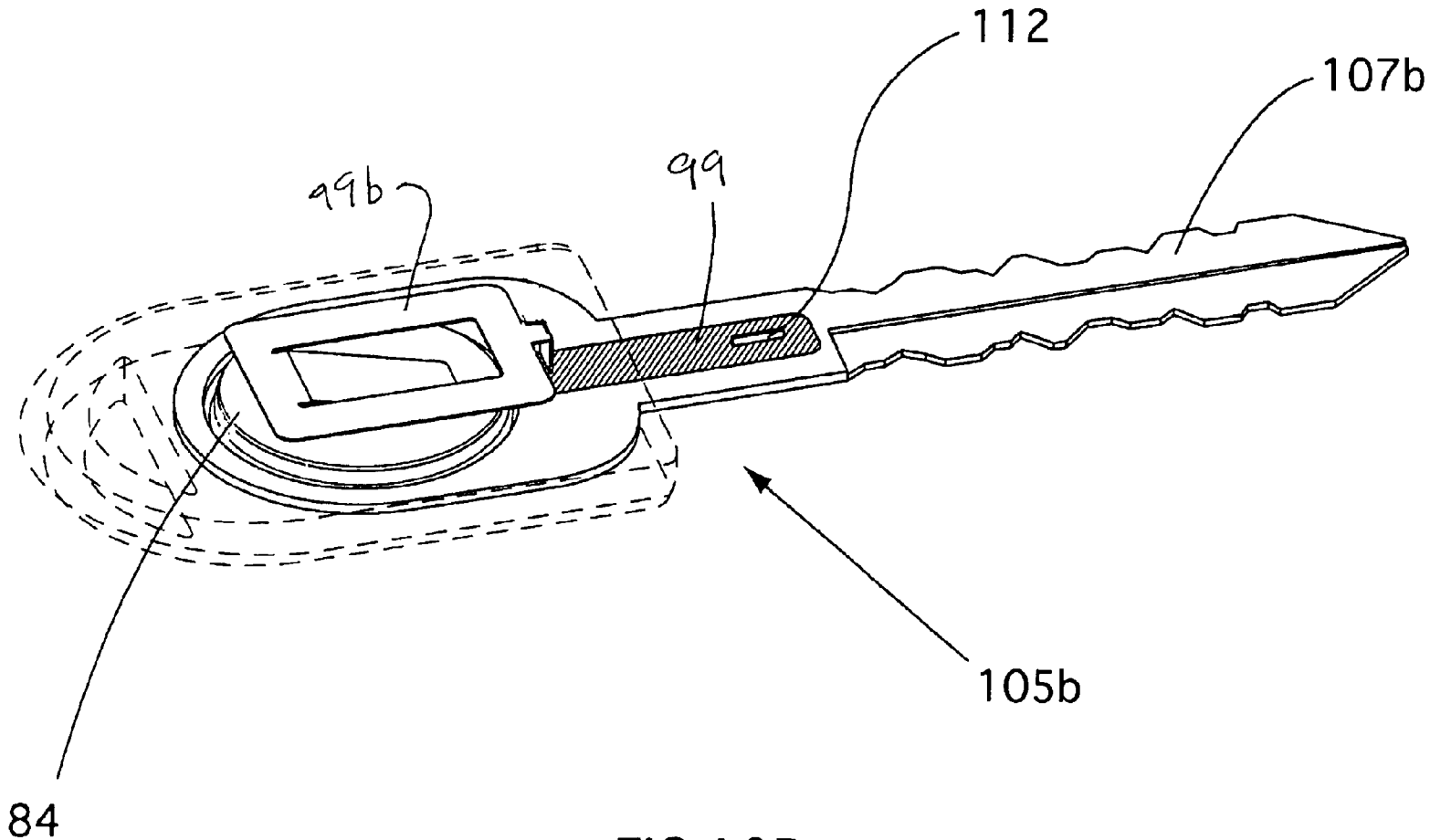
Figure 10C:
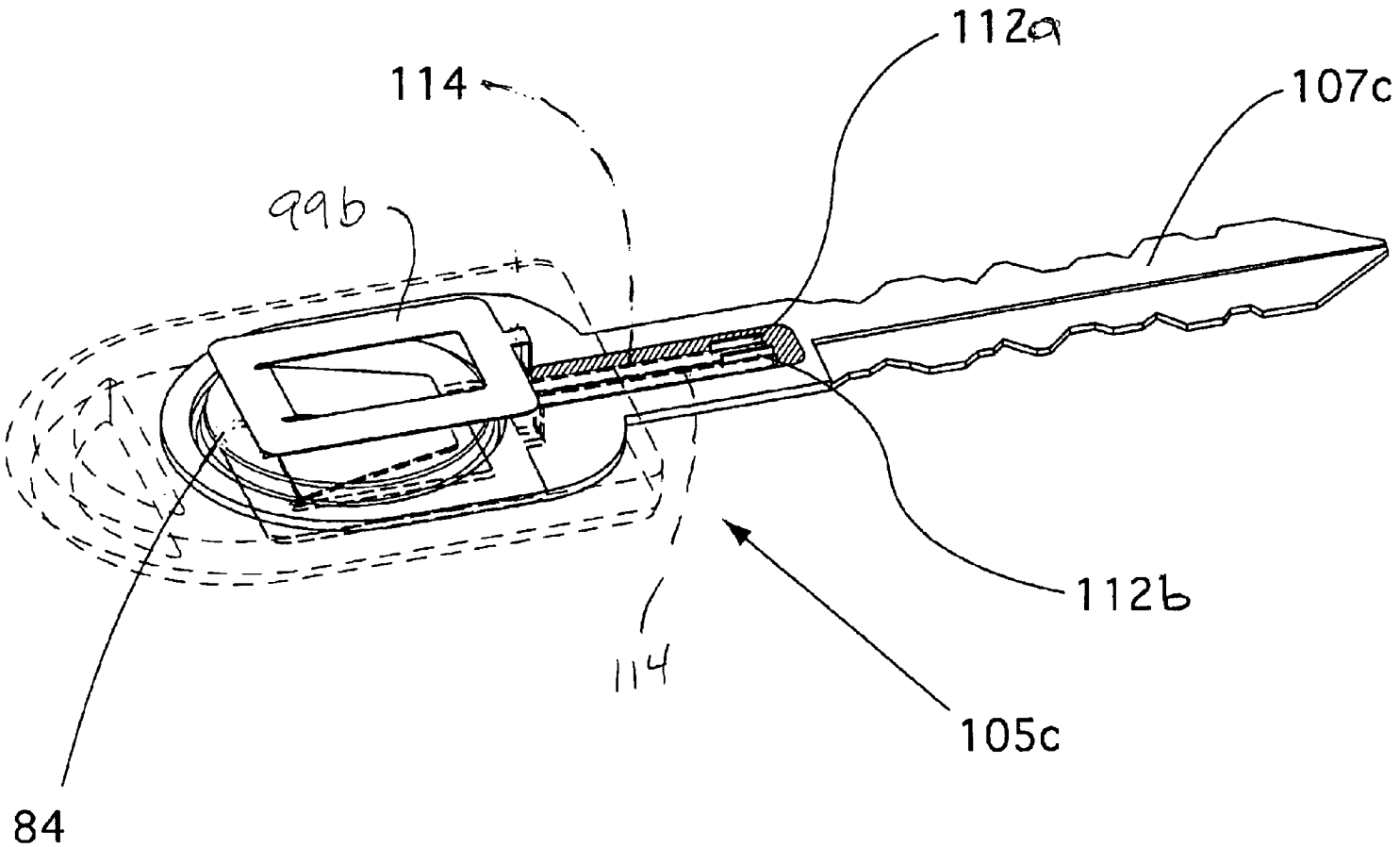

FIGS. 10B and 10C schematically show similar reversible keys 105*b* and 105*c*, but in these drawings the data contacts are shown on the key blade 107*b*, 107*c*, similar to the keys of FIGS. 9 and 9A. FIG. 10B shows a single data contact 112 in the key blade and this can be mounted in a manner similar to what is shown in FIG. 9, with an isolated conductor 114 (see FIG. 10C) leading to the data side of the memory cell 84, making contact via a flat spring conductor 99*b*. As in FIG. 9, the conductor(s) 114 preferably are contained within a plastic insert 99. The contact 112 is at both sides of the key blade 107*b*, protruding outwardly so as to be readable by a key reader contact, which can be mounted on an automotive lock cylinder as described above. In FIG. 10B, a single isolated conductor 114 (not seen in FIG. 10B) is sufficient, with the contact 112 extending through the thickness of the key blade and thus providing two identical contacts for the reversible key.

FIG. 10C merely shows that the contacts on the key blade 107*c* can include both a data contact 112*a* and a ground contact 112*b*, for the same situation described above relative to FIGS. 9A and 10A. Again, these contacts are provided on both sides of the reversible key blade, a pair of isolated conductors 114 being provided for these contacts.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

We claim:

1. A mechanical key device formed as a solid unit and fitted for insertion into a lock, comprising:

a metal key blade with mechanical bitting to fit a pattern of a lock, a key head solidly fixed to the key blade and having a front end from which the key blade extends, an electronic identification device or memory cell in the key head, grounded on one side to the metal key device and having a data side isolated from the metal key head, the identification device or memory cell comprising a self-contained device in the form of a sealed can unit comprising a conductive metal casing with serial number ID data in a one-wire bus protocol, the casing of the identification device or memory cell comprising only two terminals on two opposed sides, one of which comprises said one side grounded to metal of the key device and the other being said data side, the key device having a data contact isolated from metal of the key device and positioned to engage with a key reading contact associated with a key slot, the data contact being connected to said data side of the self-contained device, whereby data stored by the electronic identification device or memory cell may be read by reading apparatus when the key device is inserted making said one-wire bus connection.

2. The key device of claim 1, wherein the key blade is integral with the key head.

3. The key device of claim 1, wherein the key head has a hole sized to closely receive the self-contained device, making ground contact.

4. The key device of claim 3, wherein the hole has a diameter of about 16 mm.

5. The key device of claim 4, wherein the self-contained device has a thickness no more than about 3 mm.

6. The key device of claim 1, wherein the self-contained device has an internal battery.

7. The key device of claim 1, wherein the self-contained device has a thickness no more than about 3 mm.

8. The key device of claim 1, wherein the self-contained device has a thickness of about 5.9 mm.

9. The key device of claim 1, including an outer plastic cover over the key head.

10. The key device of claim 9, wherein the plastic cover comprises two half-shells secured together, with one of the two half shells carrying a conductor which engages and makes contact with the data side of the self-contained device upon securing of the two half shells over the key head.

11. The key device of claim 1, wherein the data contact of the key extends from the front end of the key head adjacent to the key shoulder, in position to engage with a key reading contact of a lock.

12. The key device of claim 1, wherein the data contact is located on a side of the key blade, and including an isolated conductor connecting the data contact with said data side terminal of the ID device.

13. The key device of claim 12, wherein the key blade is symmetrically reversible in orientation, and wherein said data contact comprises two similar data contacts, one on each side of the reversible key blade.

14. The key device of claim 1, wherein the electronic identification device or memory cell includes a microcontroller, battery and read/write memory.

15. A mechanical key device formed as a solid unit and fitted for insertion into a lock, comprising:

a metal key blade with mechanical bitting to fit a pattern of a lock, a key head integral with the key blade and having a front end from which the key blade extends, the key head including an electronic identification device or memory cell secured to the key head, the identification device or memory cell comprising a self-contained device in the form of a sealed can unit comprising a conductive metal casing with serial number ID data in a one-wire bus protocol, the casing of the identification device or memory cell comprising two terminals on two opposed sides, one being a ground side and the other being a data side, the key device having a data contact isolated from metal of the key device and positioned to engage with a key reading contact associated with a key slot, the data contact being connected to said data side terminal of the self-contained electronic ID device, and the key device further having a ground contact connected to said ground side terminal of the memory cell, positioned to engage with a ground contact associated with a key slot, whereby data stored by the electronic ID device may be read by reading apparatus when the key device is inserted making said one-wire bus connection.

16. The key device of claim 15, wherein the key head has a substantially circular recess within which the identification device or memory cell is positioned.

17. The key device of claim 15, wherein the key device has a ground contact connected to the ground side of the identification device or memory cell and positioned to engage with a ground contact of said reading apparatus at the key slot.

18. A mechanical key device formed as a solid unit and fitted for insertion into a lock, comprising:

a key blade with mechanical bitting to fit a pattern of a lock, a key head integral with the key blade and having a front end from which the key blade extends, the key head including an electronic identification device or memory cell secured to the key head, the identification device or memory cell comprising a self-contained unit in the form of a sealed can unit comprising a conductive metal casing with unique serial number ID data in a one-wire bus protocol with an external casing of the identification device or memory cell comprising two terminals on two opposed sides, one being a ground side and the other being a data side, the key device having an isolated data contact and positioned to engage with a key reading contact associated with a key slot, the data contact being connected to said data side terminal of the self-contained unit, whereby data stored by the electronic identification device or memory cell may be read by reading apparatus when the key device is inserted making said one-wire bus connection.

19. The key device of claim 18, wherein the key head has a substantially circular recess within which the identification device or memory cell is positioned.

20. The key device of claim 18, wherein the key device has a ground contact connected to the ground side of the identification device or memory cell and positioned to engage with a ground contact of said reading apparatus at the key slot.

21. The key device of claim 18, wherein the electronic identification device or memory cell includes non-volatile memory, battery and microcontroller.

22. The key device of claim 18, wherein the key head includes two said self-contained units, the key device having two said data contacts positioned to engage with two separate key reading contacts associated with a key slot.

23. The key device of claim 18, wherein the key head further includes a can-type battery in a second self-contained unit, adjacent to the identification device or memory cell, and the key device having a second isolated contact connected to the can-type battery.

24. The key device of claim 23, wherein the battery unit and the identification device or memory cell are positioned back to back and in electrical contact.

25. A key device formed as a solid unit and adapted to be received in a key slot with a reader, comprising:

a key blade adapted to be received in said key slot, a key head secured to the key blade and having a front end from which the key blade extends.

the key head including an electronic identification device or memory cell secured to the key head, the identification device or memory cell comprising a self-contained unit in the form of a sealed can unit comprising a conductive metal casing with unique serial number ID data in a one-wire bus protocol with an external casing of the identification device or memory cell comprising two terminals on two opposed sides, one being a ground side and the other being a data side, the key device having an isolated data contact and positioned to engage with a key reading contact associated with the key slot, the data contact being connected to said data side terminal of the self-contained unit, whereby data stored by the electronic identification device or memory cell may be read by reading apparatus when the key device is inserted making said one-wire bus connection.

26. The device of claim 25, wherein the key blade includes a retention means for engaging in a lock connected to said key slot, to retain the key in the slot as the key is turned in the lock.

* * * * *